US006709304B1

(12) United States Patent
Young

(10) Patent No.: US 6,709,304 B1
(45) Date of Patent: Mar. 23, 2004

(54) SPOT MARKER BUOY

(76) Inventor: Terry Lee Young, 16113 6th St. East, Redington Beach, FL (US) 33708

( * ) Notice: Subject to any disclaimer, the term of this patent is extended or adjusted under 35 U.S.C. 154(b) by 0 days.

(21) Appl. No.: 10/378,794

(22) Filed: Mar. 4, 2003

(51) Int. Cl.[7] ..... B63B 22/18
(52) U.S. Cl. ..... 441/6; 441/23; 441/26
(58) Field of Search ..... 441/6, 7, 21, 23, 441/24, 25, 26

(56) References Cited

U.S. PATENT DOCUMENTS

| | | | | | |
|---|---|---|---|---|---|
| 2,490,876 | A | * | 12/1949 | Lewis et al. | 441/6 |
| 2,562,922 | A | * | 8/1951 | Kist | 441/6 |
| 3,419,927 | A | * | 1/1969 | Stoffer et al. | 441/7 |
| 3,653,085 | A | | 4/1972 | Rovner | |
| 3,827,093 | A | | 8/1974 | Davis | |
| 4,501,563 | A | | 2/1985 | Johnson et al. | |
| 4,601,126 | A | * | 7/1986 | Klocksiem | 441/6 |
| 4,976,641 | A | | 12/1990 | D'Amico | |
| 5,376,035 | A | * | 12/1994 | Forrest | 441/26 |
| 5,449,308 | A | * | 9/1995 | Thompson | 441/6 |
| 5,613,888 | A | | 3/1997 | Lamphere | |
| 5,865,656 | A | * | 2/1999 | Sims | 441/6 |

* cited by examiner

*Primary Examiner*—S. Joseph Morano
*Assistant Examiner*—Lars A. Olson
(74) *Attorney, Agent, or Firm*—Larson & Larson, PA; James E. Larson

(57) ABSTRACT

A spot marking buoy. A flotation body, cylindrical in shape with rounded ends having a groove around the periphery of the flotation body creating a reel with one end of a string attached to the reel and the other end of the string attached to an anchor weight. The flotation body employs angular cores to receive a rubber locking cord which is affixed to the flotation body by the use of crimps or knots on the ends of the rubber locking cord with said crimps or knots being larger in circumference than the angular cores. And surface grooves on each side of the top end of the flotation body to receive and secure the rubber locking cord when in use and when storage. Included are recessed counterweights, an anchor weight and anchor weight housing for storage and a built in hand grip for reminding. When buoy is discharged into water and the anchor weight sinks and comes to rest on the bottom of a body of water, counterweights resist rotation of flotation body and unwinding of string and employment of the rubber locking cord prohibits further rotation of flotation body and unwinding of string.

7 Claims, 7 Drawing Sheets

SPOT MARKER BUOY

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

This invention relates to buoys used by fisherman and scuba divers to effectively mark a spot on the floor of a body of water. These spots are normally ledges, wrecks, natural reefs, or man made reefs.

BACKGROUND OF THE INVENTION

Discussion of Prior Art

One of the most important pieces of equipment needed for successful fishing is a spot marking buoy to indicate the location of a fishing spot or the location of some underwater structure which is not visible from the surface. This invention can also be used to mark skiing or boating courses or as warning markers. The depth of some fishing spots are pre-determined in which case a pre-determined measure of string can be tied to an anchor weight which some patented buoys promote. However, many times new spots are discovered unexpectedly and the buoy must be discharged into the water immediately to mark the spot and if too much string is released the buoy will drift off the desired spot. Some buoys attempt to use counterweights to stop unnecessary rotation of the flotation body thus releasing excessive string as in U.S. Pat. No. 4,976,641 to D'Amico. However counterweights have proved unsuccessful except in the calmest of water, which is normally not the case. Even a large ship will roll over if the seas are high enough. And a fishing buoy is much smaller than a ship. U.S. Pat. No. 4,501,563 to Johnson incorporates a flat body style in hopes of preventing the unnecessary rotation of the flotation body. The same problem of rough seas and wind will rotate the flotation body on the surface of the water. U.S. Pat. No. 3,827,093 uses two resilient bands, one to resist unwinding of string and one to prevent unwinding of string. Both bands must be completely detached from the flotation body for use thus becoming subject to inconvenience and accidental loss of bands. Another problem with buoys is the process of rewinding the string after use. Most buoys are round in shape and must be palmed by the user without any means for a grip which is very difficult especially in rough conditions. U.S. Pat. No. 4,501,563 has incorporated two handles for cranking, however without an axis rod to stabilize the flotation body during the winding process, winding is still difficult.

BACKGROUND OF THE INVENTION

Objects and Advantages

Accordingly, the objects and advantages of my invention are to provide a flotation body consisting of a single durable part as opposed to 2–3 connecting parts. Another object is to provide one affixed rubber locking cord that when employed absolutely prohibits undesired rotation of the flotation body and release of additional string and thus eliminating unnecessary human intervention. Another object is to provide a convenient easy to use built in hand grip for rewinding string Another is to provide a storage position with no cumbersome dangling parts. Further objects and advantages of my invention will become apparent from a consideration of the drawings and ensuing description.

SUMMARY

The flotation body is a single unit, generally cylindrical in shape with rounded ends, preferably molded of polystyrene closed cell foam. A groove is formed around the periphery of the flotation body forming a reel. One end of a string is tied to the center of the reel and the other end of the string is tied to an anchor weight. When buoy is discharged into the water and the weight sinks to the bottom, counterweights recessed in the flotation body will prevent excessive rotation of flotation body thus preventing excessive unwinding of the string enabling a person in the boat to quickly employ a rubber locking cord which is affixed to the flotation body thus prohibiting any further rotation of flotation body or unwinding of string. The flotation body utilizes a built in hand grip for easy and convenient rewinding of the string.

BRIEF DESCRIPTION OF THE DRAWINGS

In the drawings, closely related figures have the same number but different alphabetic suffixes. The objects, features and advantages of this invention will become more clear from the following detailed description of the drawings, wherein.

DRAWINGS

Reference Numerals

Figure 1:
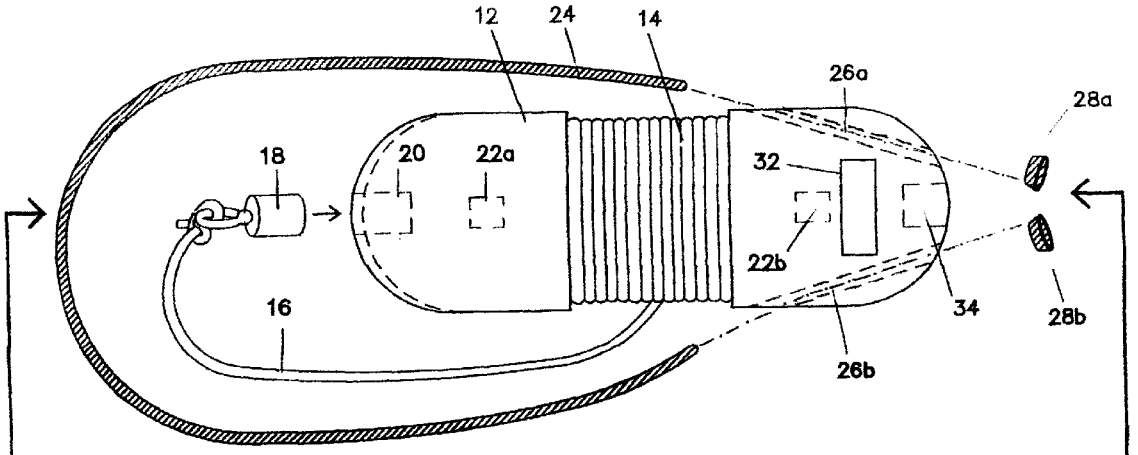
FIG. 1 is an exploded view of the invention.

12 flotation body
14 reel
16 string
18 anchor weight
20 weight housing
22 counterweight
24 rubber locking cord
26 angular core
28 crimp/knot
30 groove
32 finger slot
34 thumb core

DETAILED DESCRIPTION OF DRAWINGS

In reference to FIG. 1, it will be noted that an illustrative embodiment of the invention is denoted by the reference numeral 12 as the flotation body. The flotation body is generally cylindrical in shape with rounded ends. Said body will be approximately 7 inches in diameter and 14 inches in length and constructed generally of a polystyrene foam, preferably closed cell foam.

Figure 4:
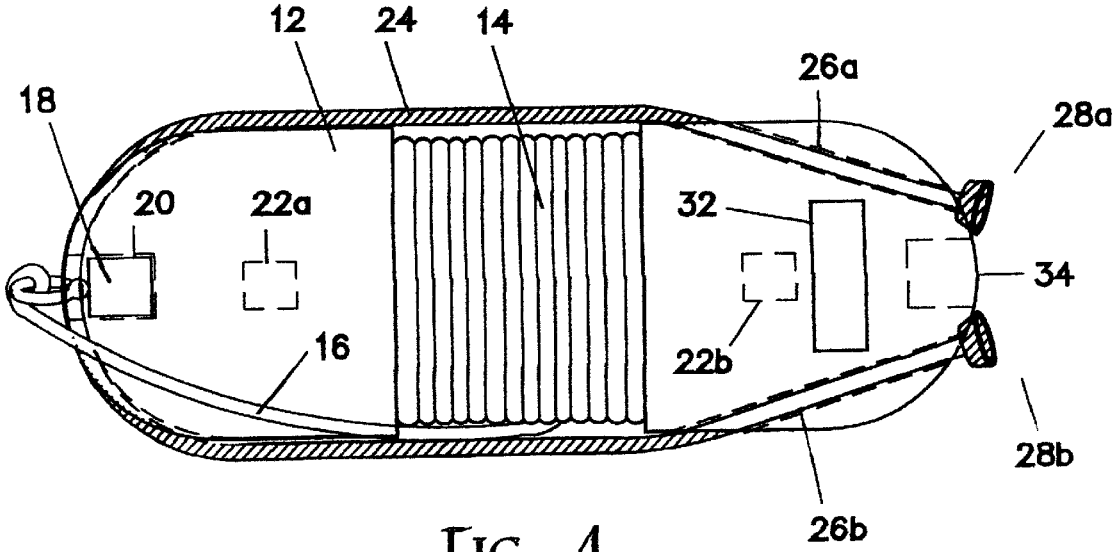
FIG. 4 is a storage view of the invention.

As shown in FIG. 1, the flotation body 12 is provided with a groove 30 which extends around the periphery of the flotation body 12 preferably in the middle of the flotation body 12 forming a reel 14. A string 16 is wound around said reel 14 with one end of the string 16 tied to the reel 14 and the other end of the string 16 tied to an anchor weight 18. The anchor weight 18 will be approximately 3 pounds in weight FIG. 1 depicts a center core in the top end of the flotation body 12 which acts as a weight housing 20 for said anchor weight 18 when buoy is in storage position as shown in FIG. 4. As seen in FIG. 1, two diametrically opposed angular cores 26 receive a rubber locking cord 24 as shown in FIG. 4. The rubber locking cord 24 will be approximately ⅜ inches in diameter. Shown in FIG. 4, the rubber locking cord 24 is inserted in and through angular cores 26 with the ends of the rubber locking cord 24 receiving a crimp or tied in a knot 28. The crimps or knots 28 will have a circumference larger than that of the angular cores 26.

Figure 2:
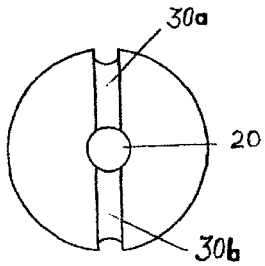
FIG. 2 is a top end view of the invention

As seen in FIG. 2, two diametrically opposed grooves 30 are provided at the top end of the flotation body 12. The grooves 30 will extend approximately 4 inches from the center core for weight housing 20 down each side of the flotation body. The grooves 30 will receive and hold firmly in place said rubber locking cord 24 when rubber locking cord 24 is in use as seen in FIG. 8.

Figure 3:
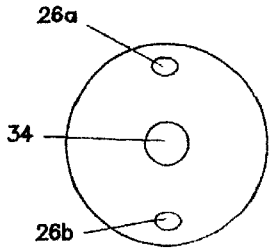
FIG. 3 is a bottom end view of the invention.
Figure 5:
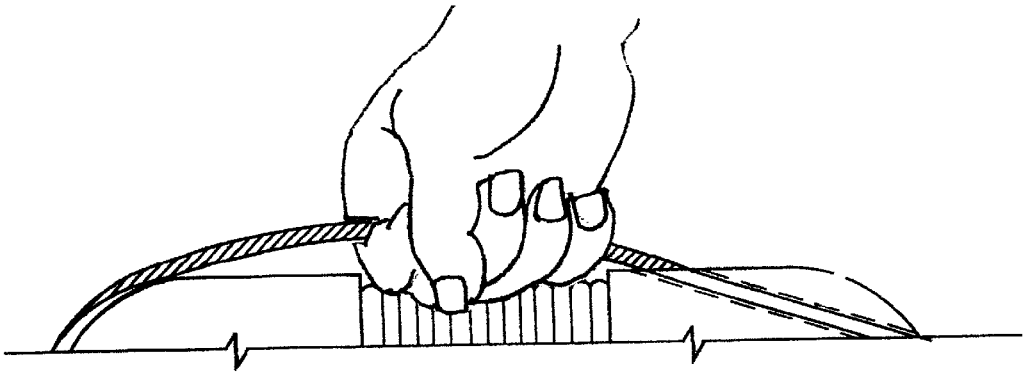
FIG. 5 is a carrying view of the invention.

FIG. 3 depicts the bottom end of the flotation body revealing the angular cores 26 in relation to a center core wherein a thumb core 34 is formed and works in relation to a finger slot 32 for the purpose of a hand grip for rewinding of string.

Figure 7:
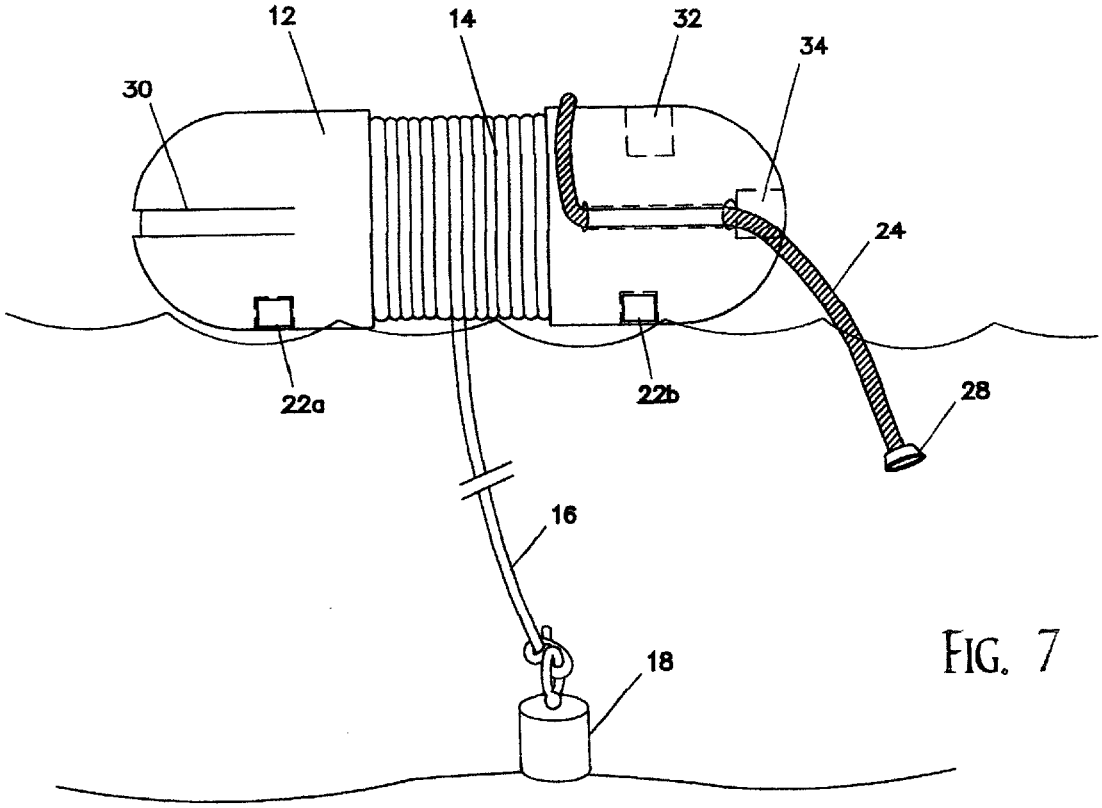
FIG. 7 is a counterweight use only view of the invention.
Figure 8:
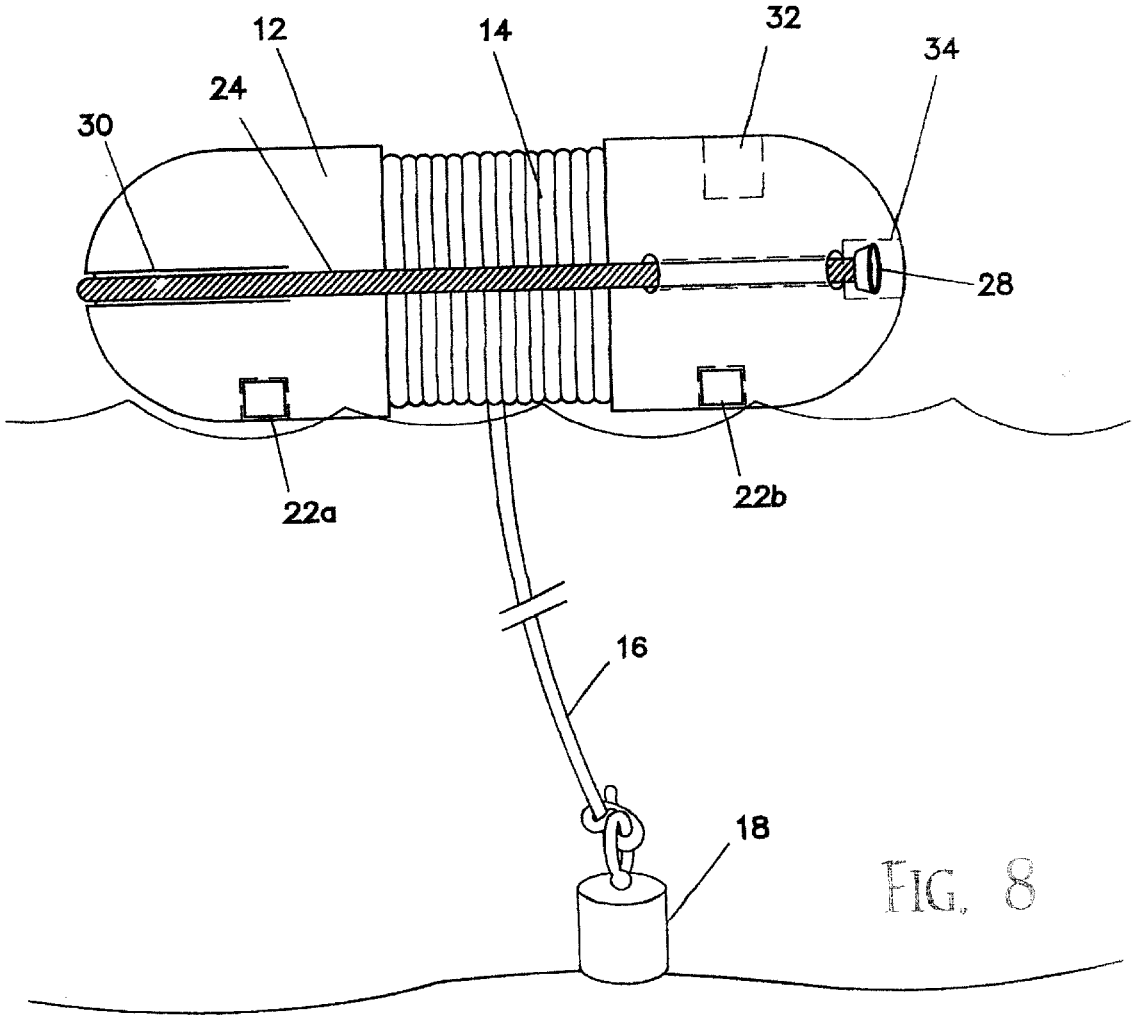
FIG. 8 is a view of the rubber locking cord in use.

As seen in FIG. 7 and FIG. 8, counterweights 22 are recessed below the surface of the flotation body 12 and on each half of the flotation body 12.

Operation

Figure 6:
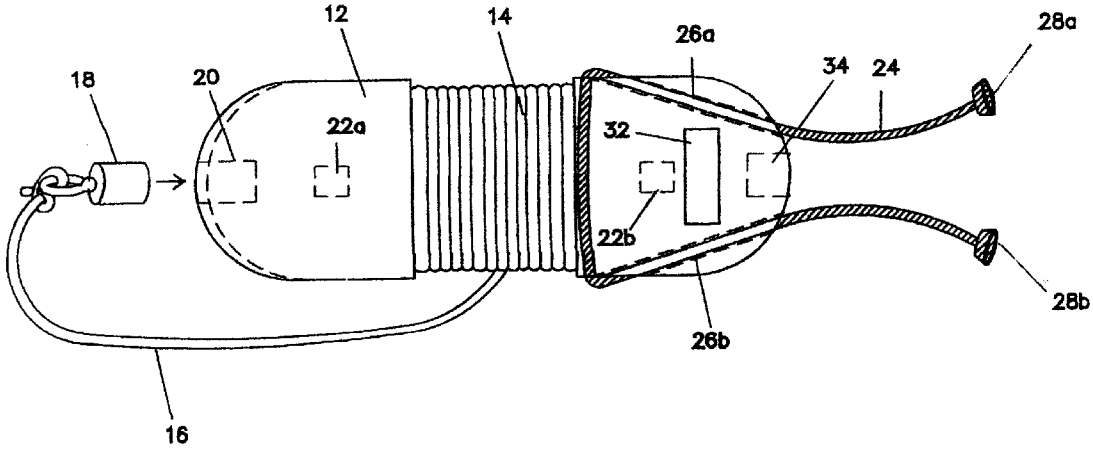
FIG. 6 is a ready to discharge view of the invention.

When it is desired to mark a particular spot in a body of water, the buoy as shown in FIG. 2 is removed from storage in its storage position. As shown in FIG. 6, the release position is established by removing anchor weight 18 from the weight housing 20 and removing the rubber locking cord 24 from grooves 30 as seen in FIG. 6. The rubber locking cord 24 is pulled through the angular cores 26 so as not to encumber string 16 as the flotation body 12 rotates when string 16 unwinds from reel 14 when anchor weight sinks to the bottom of body of water as seen in FIG. 7.

The buoy is discharged most commonly from a boat and the anchor weight 18 sinks and comes to rest on the bottom of body of water as seen in FIG. 7. Counterweights 22 will prevent the excessive rotation of the flotation body and the release of excessive string from reel 14. Please note that counterweights will hold the buoy in a position only in the calmest of water which is usually not the case. After anchor weight 18 comes to rest on the bottom of body of water, a person in the boat can quickly place the rubber locking cord 24 over the top end of flotation body 12 and secure the rubber locking cord in the grooves 30, thus prohibiting any further rotation of the flotation body or the release of any additional string 16.

Figure 10:
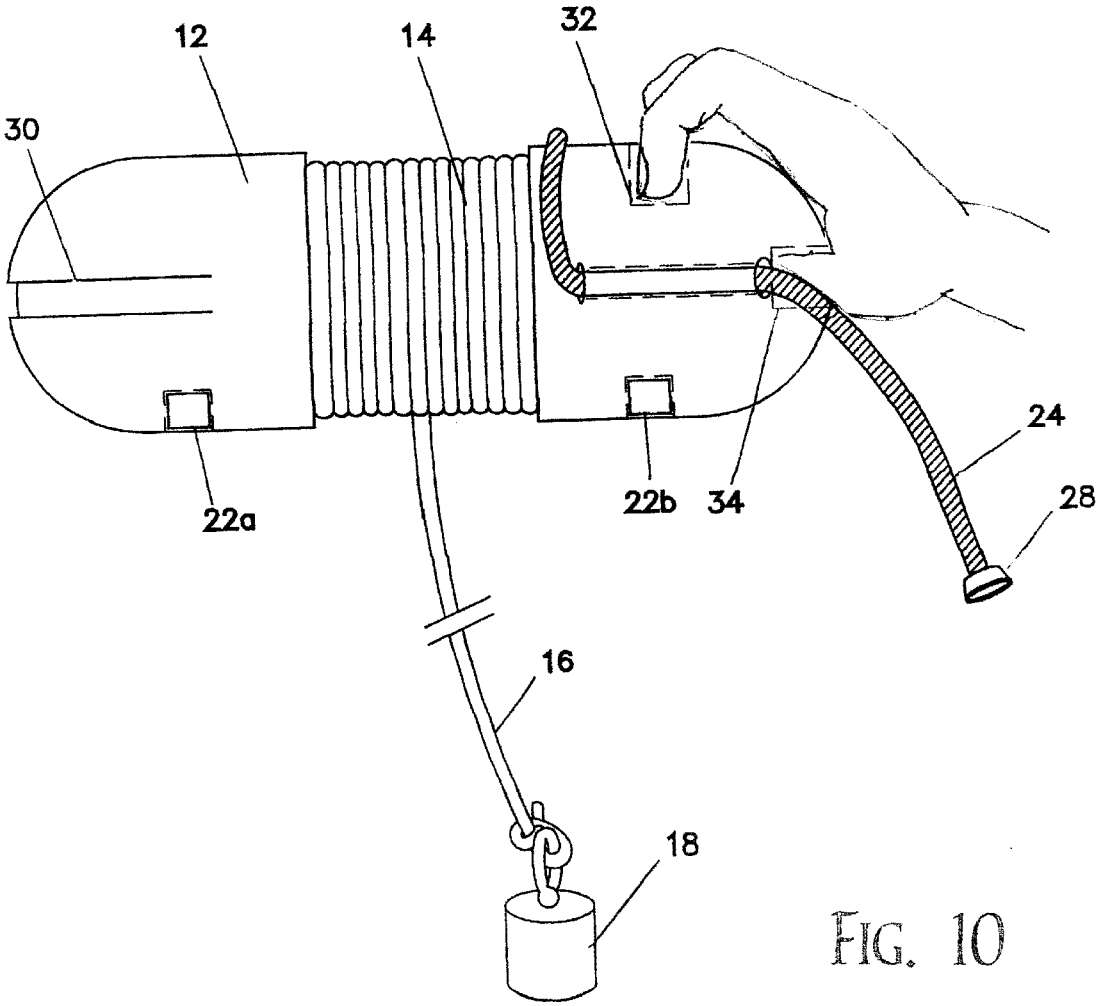
FIG. 10 is a view of the invention when using the hand grip during rewinding.

When it is time to retrieve the buoy from the water a person on the boat lifts the buoy from the water and pulls the rubber locking cord 24 through the angular cores 26 so not to encumber the string 16 during the rewinding process as seen in FIG. 10. Finger slot 32 and thumb core 34 provide a convenient and easy to use built in hand grip for rewinding as seen in FIG. 10.

Figure 9:
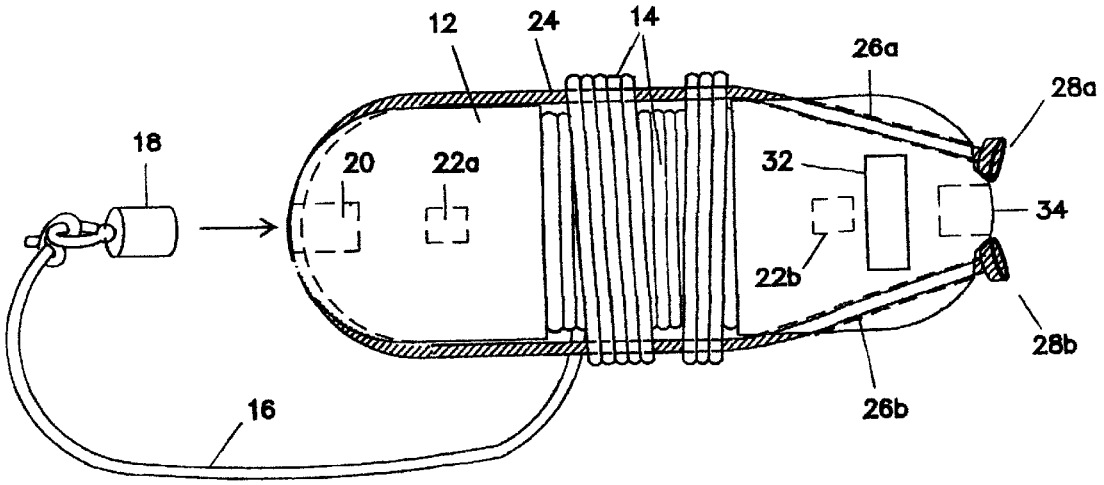
FIG. 9 is a view of the invention when using a predetermined length of string.

When a location with a predetermined depth is being marked, the rubber locking cord 24 process can be eliminated by measuring out the pre-determined length of string 16 and placing the rubber locking cord 24 in the grooves 30 and winding the string 16 around the outside of the rubber locking cord 24 shown in FIG. 9. When the pre-determined length of string 16 has unwound, the already placed rubber locking cord 24 will prohibit rotation of flotation body and the release of any additional string 16.

Conclusion, Ramification, and Scope of Invention

Thus the reader will see that the spot marking buoy of the invention provides a highly reliable easy to operate, yet economical device that can be used by persons of almost any age.

This invention provides a light weight, easy to store, and easy to carry unit without cumbersome dangling parts.

This invention provides a one step locking system which consists of just one movable part that is permanently affixed to the flotation body thus eliminating the risk of part loss and malfunction.

This invention provides a simple and convenient unique built in hand grip which contributes tremendously to the ease of rewinding.

While my above description contains many specifications, these should not be construed as limitations on the scope of the invention, but rather as an exemplification of one preferred embodiment there of. Other variations are possible. For example, the flotation body can have other shapes such as spherical or oval. Instead of angular cores 26, rings, fittings, or clamps can be used to affix the rubber locking cord 24 to the flotation body 12. Counterweights 22 can be glued to the surface of the flotation body 12 instead of being recessed below the surface of the flotation body 12.

Accordingly, the scope of the invention should be determined not by the embodiment illustrated but by the appended claims and their legal equivalents.

I claim:

1. A spot marker buoy comprising:

a) a cylindrically shaped flotation body having opposed top and bottom rounded ends;

b) a reel having a peripheral groove formed around an exterior of said flotation body with a string having a first end attached to an anchor weight and a second end attached to said reel, the string being wound around said reel;

c) a center core formed in the flotation body top end for containing the anchor weight during storage of the spot marker buoy;

d) a rubber locking cord affixed to the flotation body for prohibiting rotation of the flotation body and for prohibiting additional release of the string after deployment of the spot marker buoy, the rubber locking cord having opposed ends;

e) two diametrically opposed angular cores formed through the floatation body bottom end for receiving the rubber locking cord opposed ends; and f) a pair of crimps or knots having a larger circumference than that of the angular cores and applied to the opposed ends of the rubber locking cord for affixing the rubber locking cord to the flotation body.

2. The spot marker buoy of claim 1, further comprising at least two counterweights recessed below a surface of the flotation body for preventing excessive release of the string.

3. The spot marker buoy of claim 1, further comprising two diametrically opposed surface grooves formed on the top end of the flotation body for securing the rubber locking cord to the spot marker buoy.

4. The spot marker buoy of claim 1, further comprising a built in hand grip for use in rewinding the string.

5. The spot marker buoy of claim 1, wherein the rubber locking cord is used for marking a spot of a pre-determined depth by use of a pre-determined measurement of string.

6. The marker buoy of claim 1, wherein said flotation body is constructed of rigid polystyrene foam.

7. A spot marker buoy comprising:

a) a cylindrically shaped flotation body having opposed top and bottom rounded ends;

b) a reel having a peripheral groove formed around an exterior of said flotation body at a middle portion thereof between the opposed top and bottom ends, a string having a first end attached to an anchor weight and a second end attached to said reel, the string being wound around said reel;

c) a center core formed in the flotation body top end for containing the anchor weight during storage of the spot marker buoy;

d) a rubber locking cord affixed to the flotation body for prohibiting rotation of the flotation body and for prohibiting additional release of the string after deployment of the spot marker buoy, the rubber locking cord having opposed ends;

e) two diametrically opposed angular cores formed through the floatation body bottom end for receiving the rubber locking cord opposed ends;

f) a pair of crimps or knots having a larger circumference than that of the angular cores and attached to the opposed ends of the rubber locking cord for affixing the rubber locking cord to the flotation body; and g) a built in hand grip for use in rewinding the string, the hand grip including a center thumb core formed at the bottom end of the flotation body for receiving a thumb of a user of the spot marker buoy and a surface slot formed in the flotation body proximal to the center thumb core for receiving fingers of a user of the spot marker buoy.

* * * * *